US005192736A

United States Patent [19]

Hanada et al.

[11] Patent Number: 5,192,736

[45] Date of Patent: Mar. 9, 1993

[54] HEAT-SENSITIVE RECORDING MATERIALS

[75] Inventors: Kazuyuki Hanada; Iwao Misaizu; Masashi Saito; Katsutoshi Torii; Katsumi Kuriyama, all of Tokyo, Japan

[73] Assignees: Dainichiseika Color & Chemicals Mfg. Co., Ltd.; Ukima Colour & Chemicals Mfg. Co., Ltd., both of Tokyo, Japan

[21] Appl. No.: 813,180

[22] Filed: Dec. 24, 1991

[30] Foreign Application Priority Data

Dec. 28, 1990 [JP] Japan ..... 2-415441

[51] Int. Cl.[5] ..... B41M 5/26

[52] U.S. Cl. ..... 503/226; 428/423.1; 428/423.7; 428/447; 428/488.4

[58] Field of Search ..... 428/423.1, 423.7, 447, 428/488.4; 503/226

[56] References Cited

U.S. PATENT DOCUMENTS 4,895,829 1/1990 Hanada et al. ..... 503/227

FOREIGN PATENT DOCUMENTS 62-220385 9/1987 Japan .
63-191679 8/1988 Japan .

*Primary Examiner*—Paul J. Thibodeau
*Assistant Examiner*—D. S. Nakarani
*Attorney, Agent, or Firm*—Oblon, Spivak, McClelland, Maier & Neustadt

[57] ABSTRACT

A heat-sensitive recording material comprises a base sheet material, a heat-sensitive recording layer provided on one side of the base sheet material and a heat-resistant layer provided on the other side of the base sheet material. The heat-resistant layer is formed of a resin which is modified with a silane coupling agent, which contains at least one free isocyanate group, and containing one or more hydrolyzable silyl groups in side chains of its molecule.

10 Claims, No Drawings

HEAT-SENSITIVE RECORDING MATERIALS

BACKGROUND OF THE INVENTION (1) Field of the Invention

The present invention relates to heat-sensitive transfer materials, and more specifically to heat-sensitive recording materials useful in a thermal ink-transfer recording process or a sublimation ink-transfer recording process.

(2) Description of the Related Art

Conventionally-known transfer recording processes include thermal ink-transfer recording processes and sublimation ink-transfer recording processes. According to the former processes, a heat-resistant recording layer is formed on a base sheet such as a polyester film by having a dye or pigment carried together with a binder resin on one side of base sheet. The base sheet is heated in a pattern from the back side thereof so that the dye or pigment is transferred onto another material. According to the latter processes, a dye alone is caused to sublimate so that it is transferred onto another material.

In each of these processes, thermal energy is applied from the back side of a base sheet in each of these processes. The back side of a heat-sensitive transfer material to be employed is, therefore, required to have sufficient lubricity, releasability, non-stickiness and the like so that a thermal head does not stick on the back side, in other words, does not develop any sticking problem.

It has therefore been the conventional practice to form a layer of a silicone resin, melamine resin, phenol resin, polyimide resin, epoxy resin or modified cellulose resin or a mixture thereof on the back side of a base sheet in a heat-sensitive recording material (see Japanese Patent Publication No. 58-13359).

Most of these resins are, however, thermosetting resins making use of various curing agents. A heating step is, therefore, required for curing upon formation of a heat-resistant layer on a heat-sensitive recording material, leading to the problem that the production process is cumbersome. Moreover, so-formed heat-resistant layer itself is weak and is inferior in adhesion in spite of its high melting point, leading to the problem that the film layer may peel off as dust particles upon printing and may give a trouble to a thermal head.

With a view toward overcoming the problems described above, it has been proposed to add an isocyanate or the like to a thermoplastic resin such as an acrylic resin, polyurethane resin, polyester resin or polybutadiene resin and then to cure the resulting resin to provide a heat-resistant layer and, further, to incorporate a lubricant or the like in the resulting resin to allow a printing device to smoothly slide thereon (Japanese Patent Application Laid-Open No. 225994/1984).

According to the above patent publication, the curing of the isocyanate is said to proceed at room temperature. In practice, however, the above proposal has the problems that the pot life is insufficient and the resulting resin may not be cured sufficiently due to reactions of the isocyanate with water and other impurities. In addition, the lubricant added to provide the heat-resistant layer with smooth sliding property is accompanied by the potential problems that it may bleed out if stored for a long time, or may produce dusts on a head during printing.

The present assignees have already proposed that the use of a silicone copolymer resin in stead of the above-mentioned resins for the formation of a heat-resistant layer can provide a heat-sensitive recording material excellent in various properties such as heat resistance, lubricity and non-stickiness (see Japanese Patent Application Laid-Open Nos. 61-227087 and 62-202786).

SUMMARY OF THE INVENTION

An object of the present invention is, therefore, to make further improvements over the conventional technology and to provide a heat-sensitive recording material having a readily-formable heat-resistant layer and excellent properties.

The present invention, therefore, provides a heat-sensitive recording material comprising a base sheet material, a heat-sensitive recording layer provided on one side of the base sheet material and a heat-resistant layer provided on the other side of the base sheet material. The heat-resistant layer of the heat-sensitive recording material is formed of a resin modified with a silane coupling agent, which contains at least one free isocyanate group, and containing one or more hydrolyzable silyl groups in side chains of the molecule of the resin.

By forming a heat-resistant layer of a heat-sensitive recording material using a resin modified with a silane coupling agent, which contains at least one free isocyanate group, and containing one or more hydrolyzable silyl groups in side chains of the molecule of the resin, the heat-resistant layer can be crosslinked by moisture in the air or water. The resin can, therefore, be provided in one pack for subsequent curing, leading to simplification in the forming process of the heat-resistant layer.

In addition, the adhesion of the heat-resistant layer to the base sheet material has been improved by the existence of hydrolyzable silyl groups. Thus, heat-sensitive recording materials having excellent properties can be obtained according to the present invention.

DETAILED DESCRIPTION OF THE INVENTION

Preferred specific examples of the modifier by which the resin used in the present invention is modified include, for example, the compounds as described below:

(1) Silane coupling agents containing at least one free isocyanate group.

$$(R^1O)_n-\overset{(R^2)_m}{\overset{|}{Si}}-R^3-NCO$$

wherein $R^1$ is a lower alkyl group, $R^2$ is a lower alkyl or lower alkoxy group, $R^3$ is $C_{1-6}$ alkyl group, m stands for an integer of 1–3 and n is 3-m.

(2) Reaction products of silane coupling agents containing one or more reactive organic functional groups and organic polyisocyanates, said reaction products containing at least one free isocyanate group in the molecules thereof.

Examples of the silane coupling agent containing one or more reactive organic functional groups include the compounds represented by the following formula:

$$X-R^4-\overset{(R^2)_m}{\overset{|}{Si}}(OR^1)_n$$

X represents a group reactive with an isocyanate group, for example, an amino group, an epoxy group, a hydroxyl group or a thiol group, with an amino group, an epoxy group or a thiol group being particularly preferred.

$R^1$–$R^3$, m and n have the same meanings as defined above. $R^4$ represents a divalent organic group, with a $C_{2-20}$ aliphatic, aromatic or aliphatic aromatic groups being preferred. These groups may contain therein oxygen, nitrogen and sulfur atoms as bond group or groups.

Preferred specific examples of the above silane coupling agent containing a reactive organic functional group include:

$H_2N(CH_2)_2NH(CH_2)_3Si(OCH_3)_2(CH_3)$ $H_2N(CH_2)_2NH(CH_2)_3Si(OC_2H_5)_2(CH_3)$ $H_2N(CH_2)_2NH(CH_2)_3Si(OCH_3)_3$ $H_2N(CH_2)_2NH(CH_2)_3Si(OC_2H_5)_3$ $H_2N(CH_2)_3Si(OCH_3)_3$ $H_2N(CH_2)_3Si(OC_2H_5)_3$

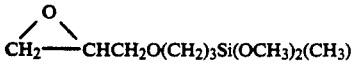

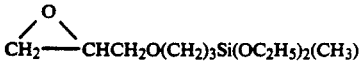

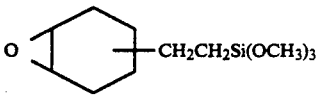

$HS(CH_2)_3Si(OCH_3)_3$ $HS(CH_2)_3Si(OC_2H_5)_3$ $H_2N(CH_2)_2NHCH_2$—Ph—$CH_2CH_2Si(CH_3)_3$

It is to be noted that the above silane coupling agents are merely illustrative silane coupling agents preferred in the invention and the invention is not necessarily limited to such exemplified compounds. The above-exemplified and other compounds are commercially sold these days and are hence readily available on the market. They are all usable in the invention.

As the organic polyisocyanate to be reacted with the above silane coupling agents, conventionally-known organic polyisocyanates are all usable. Preferred examples of polyisocyanates include:

Toluene-2,4-diisocyanate,
4-Methoxy-1,3-phenylene diisocyante,
4-Isopropyl-1,3-phenylene diisocyanate,
4-Chloro-1,3-phenylene diisocyanate,
4-Buthoxy-1,3-phenylene diisocyanate,
2,4-Diisocyanate-diphenylether,
Methylene diisocyanate,
4,4-Methylenebis(phenyl isocyanate),
Durylene diisocyanate,
1,5-Naphthalene diisocyanate,
Benzidine diisocyanate,
o-Nitrobenzidine diisocyanate,
4,4-Diisocyanate dibenzidyl,
1,4-Tetramethylene diisocyanate,
1,6-Tetramethylene diisocyanate,
1,10-Decamethylene diisocyanate,
1,4-Cyclohexylene diisocyanate,
Xylylene diisocyanate,
4,4-Methylenebis(cyclohexyl isocyanate), and
1,5-Tetrahydronaphthalene diisocyanate.

Adducts of the above-exemplified organic polyisocyanates with other compounds, for example, those represented by the following formulas can also be mentioned, although the invention is not limited to the use of these examples.

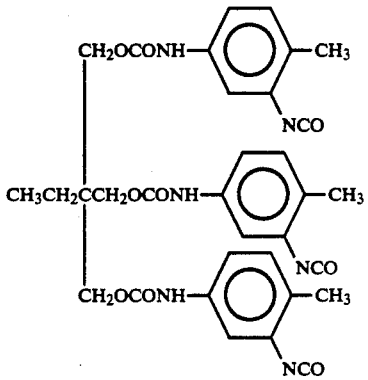

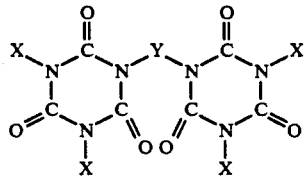

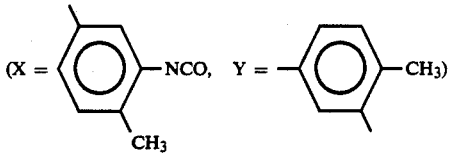

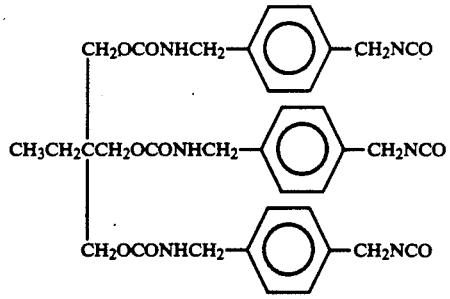

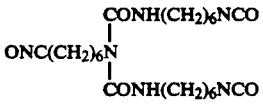

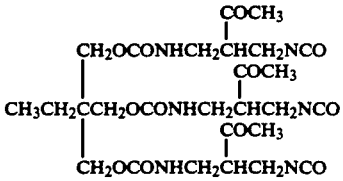

-continued

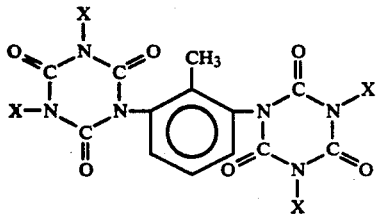

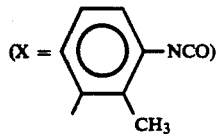

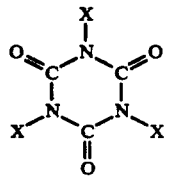

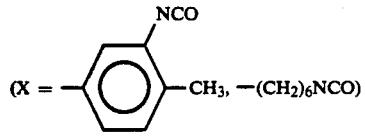

Needless to say, urethane prepolymers obtained by reacting these organic polyisocyanates with low-molecular-weight polyols or polyamines to form end isocyanates can also be used. Among then, yellowing-free polyisocyanates are particularly preferred.

As resins which can be used in the heat-sensitive recording materials of the present invention, conventionally-known various film-forming resins can be mentioned. They are all usable. Examples of them include various silicone copolymer resins, i.e. which are reaction products of a silicone modifier containing at least one free isocyanate group with polyvinyl butyral resins, polyvinyl formal resins, acrylic resins, polyurethane resins, polyester resins, vinyl chloride/vinyl acetate/vinyl alcohol copolymer resins, alkyl resins, epoxy resins, polybutadiene resins, polyurea resins, modified cellulose resins, silicone resins, melamine resins, fluororesins, polyamide resins, phenoxy resins; or siloxane-modified polyester resins obtained by the reaction of siloxane compounds containing one ore more active hydrogen groups and ϵ-caprolactone. These film-forming resins containing siloxane segments are readily available, for example, under the name of "Diallomer" (trade mark) from Dainichiseika Color & Chemicals Mfg. Co., Ltd for use in the invention.

In addition, the above-mentioned resins without polysiloxane segments can also be used in combination with those containing polysiloxane segments in the invention.

Incidentally, these resins can be used either singly or in combination and also as solutions or dispersions in an organic solvent.

When the heat-resistant layer of the heat-sensitive recording material of the present invention is brought into contact with moisture in the air, water, steam or the like, the hydrolyzable silyl groups therein undergoes a crosslinking reaction, leading to the curing of the agent.

In the present invention, it is preferable to add a catalyst to the heat-resistant layer of the heat-sensitive recording material in order to accelerate the above silanol condensation. Examples of the catalyst include carboxylate salts such as alkyl titanate salts, tin octylate, and dibutyltin dilaurate; amine salts such as dibutylamine-2-ethylhexoate; and other acidic and basic catalysts. It is preferable to add the catalyst in a proportion of about 0.0001–5 wt. %.

The content of silanol groups after modification is preferably within a range of from 0.1 wt. % to 60 wt. % based on the resin so modified and more preferably within a range of 3–40 wt. % in view of the processability and adhesion.

The present invention will hereinafter be described more specifically by the following examples and comparative examples, in which all designations of "part or parts" and "%" are on a weight basis unless otherwise specifically indicated.

REFERENTIAL EXAMPLE 1 (PRODUCTION OF MODIFIER)

While 150 parts of an adduct of hexamethylene diisocyanate and water ("Duraconate 24A-100", trade name; product of Asahi Chemical Industry Co., Ltd.; NCO %=23.5) were stirred thoroughly at room temperature, 124 parts of 3-aminopropyltriethoxysilane were gradually added dropwise and reacted, whereby 274 parts of a modifier (I) were obtained in the form of a colorless clear viscous liquid.

In an infrared absorption spectrum of the modifier (I) so obtained, absorption by free isocyanate groups was observed at 2,270 $cm^{-1}$ and an absorption band based on —Si—O— groups was also observed at 1,090 $cm^{-1}$. As a result of a quantitative analysis of free isocyanate groups in the modifier, their content was found to be 3.92% while the theoretical value is 4.20%.

REFERENTIAL EXAMPLE 2 (PRODUCTION OF MODIFIER)

While 150 parts of an adduct of trimethylol propane and hexamethylene diisocyanate at a molar ratio of 1:3 ("Colonate HL", trade name; product of Nippon Polyurethane Co., Ltd.; NCO %=12.5; solid content: 75%) were stirred thoroughly at room temperature, 76 parts of N-phenyl-γ-aminopropyltriethoxysilane were gradually added dropwise and reacted, whereby 185 parts of a modifier (II) were obtained in the form of a colorless clear viscous liquid.

In an infrared absorption spectrum of the modifier (II), absorption by free isocyanate groups was observed at 2,270 $cm^{-1}$ and an absorption band based on —Si—O— groups was also observed at 1,090 $cm^{-1}$. As a result of a quantitative analysis of free isocyanate groups in the modifier, their content was found to be 2.82% while the theoretical value is 3.12%.

REFERENTIAL EXAMPLE 3 (PRODUCTION OF MODIFIER)

While 150 parts of a trimer of hexamethylene diisocyanate ("Colonate EH", trade name; product of Asahi Chemical Industry Co., Ltd.; NCO %=21.3) were stirred thoroughly at room temperature, 99 parts of γ-mercaptopropyltrimethoxysilane were gradually added dropwise and reacted, whereby 249 parts of a modifier (III) were obtained in the form of a colorless clear viscous liquid.

In an infrared absorption spectrum of the modifier (III), absorption by free isocyanate groups was observed at 2,270 $cm^{-1}$ and an absorption band based on —Si—O— groups was also observed at 1,090 $cm^{-1}$ As a result of a quantitative analysis of free isocyanate groups in the modifier, their content was found to be 3.72% while the theoretical value is 4.0%.

REFERENTIAL EXAMPLE 4 (MODIFICATION OF RESIN)

To 300 parts of a silicone-acryl polyol copolymer resin (solid content: 40%; hydroxyl number: 32 mg-KOH/g; "Diallomer", trade mark; product of Dainichiseika Color & Chemicals Mfg. Co., Ltd.), which had been obtained by reacting a silicone modifier containing at least one free isocyanate group with an acrylic polyol, 20 parts of the modifier (I) of Referential Example 1 were added and reacted at 80° C. for 8 hours. After the elimination of isocyanate groups was recognized, the solid concentration of the resultant reaction mixture was adjusted to 20%, whereby a modified film-forming resin solution (A) was obtained.

REFERENTIAL EXAMPLE 5 (MODIFICATION OF RESIN)

To 300 parts of a silicone-polyvinyl butyral copolymer resin (solid content: 40%; hydroxyl number: 56 mg-KOH/g; "Diallomer", trade mark; product of Dainichiseika Color & Chemicals Mfg. Co., Ltd.) which had been obtained by reacting a silicone modifier containing at least one free isocyanate group with a polyvinyl butyral resin, 24 parts of the modifier (II) of Referential Example 2 were added and reacted at 80° C. for 8 hours. After the elimination of isocyanate groups was recognized, the solid concentration of the resultant reaction mixture was adjusted to 20%, whereby a modified film-forming resin solution (B) was obtained.

REFERENTIAL EXAMPLE 6 (MODIFICATION OF RESIN)

To 300 parts of a silicone-polyvinyl formal copolymer resin (solid content: 40%; hydroxyl number: 42 mg-KOH/g; "Diallomer", trade mark; product of Dainichiseika Color & Chemicals Mfg. Co., Ltd.), which can be obtained by reacting a silicone modifier containing at least one free isocyanate group with a polyvinyl formal resin, 21 parts of the modifier (III) of Referential Example 3 were added and reacted at 80° C. for 8 hours. After the elimination of isocyanate groups was recognized, the solid concentration of the resultant reaction mixture was adjusted to 20%, whereby a modified film-forming resin solution (C) was obtained.

REFERENTIAL EXAMPLE 7 (MODIFICATION OF RESIN)

To 300 parts of a silicone-polyurethane copolymer resin (solid content: 35%; "Diallomer", trade mark; product of Dainichiseika Color & Chemicals Mfg. Co., Ltd.), 15 parts of an isocyanate-containing silane coupling agent $[(CH_3O)_3Si(CH_2)_3NCO$; "KBM-9007", trade name; product of Shin-Etsu Chemical Co., Ltd.) were added and reacted at 80° C. for 8 hours. After the elimination of isocyanate groups was recognized, the solid concentration of the resultant reaction mixture was adjusted to 20%, whereby a modified film-forming resin solution (D) was obtained.

REFERENTIAL EXAMPLE 8 (MODIFICATION OF RESIN)

To 300 parts of a siloxane-modified polyester resin (solid content: 50%; hydroxyl number: 12 mg-KOH/g; "Diallomer", trade mark; product of Dainichiseika Color & Chemicals Mfg. Co., Ltd.) which had been obtained by reacting a siloxane compound containing one or more active hydrogen groups and ε-caprolactone, 12 parts of an isocyanate-containing silane coupling agent $[(C_2H_5O)_3Si(CH_2)_3NCO$; "KBM-9007", trade name; product of Shin-Etsu Chemical Co., Ltd.) were added and reacted at 80° C. for 8 hours. After the elimination of isocyanate groups was recognized, the solid concentration of the resultant reaction mixture was adjusted to 20%, whereby a modified film-forming resin solution (E) was obtained.

EXAMPLE 1

The modified film-forming resin solution (A) (100 parts) obtained in REFERENTIAL EXAMPLE 4, 100 parts of methyl ethyl ketone, 1.0 part of water and 0.01 part of tin octylate were mixed and stirred thoroughly, whereby a coating formulation for the formation of the heat-resistant layer of the heat-sensitive recording material of the present invention was obtained.

EXAMPLE 2

The modified film-forming resin solution (B) (100 parts) obtained in REFERENTIAL EXAMPLE 5, 100 parts of methyl ethyl ketone, 1.0 part of water and 0.01 part of tin octylate were mixed and stirred thoroughly, whereby a coating formulation for the formation of the heat-resistant layer of the heat-sensitive recording material of the present invention was obtained.

EXAMPLE 3

The modified film-forming resin solution (C) (100 parts) obtained in Referential Example 6, 100 parts of methyl ethyl ketone, 1.0 part of water and 0.01 part of tin octylate were mixed and stirred thoroughly, whereby a coating formulation for the formation of the heat-resistant layer of the heat-sensitive recording material of the present invention was obtained.

EXAMPLE 4

The modified film-forming resin solution (D) (100 parts) in Referential Example 7, 100 parts of methyl ethyl ketone, 1.0 part of water and 0.01 part of tin octylate were mixed and stirred thoroughly, whereby a coating formulation for the formation of the heat-resistant layer of the heat-sensitive recording material of the present invention was obtained.

EXAMPLE 5

The modified film-forming resin solution (E) (100 parts) obtained in Referential Example 8, 100 parts of methyl ethyl ketone, 1.0 part of water and 0.01 part of tin octylate were mixed and stirred thoroughly, whereby a coating formulation for the formation of the heat-resistant layer of the heat-sensitive recording material of the present invention was obtained.

COMPARATIVE EXAMPLE 1

In a mixture consisting of 200 parts of methyl ethyl ketone and 50 parts of toluene, 150 parts of polybutylene adipate (molecular weight: 2,000) and 15 parts of 1,3-butanediol were dissolved. While the solution was stirred thoroughly at 60° C., a solution of 62 parts of hydrogenated MDI in 171 parts of methyl ethyl ketone was gradually added dropwise. After the dropwise addition was completed, they were reacted at 80° C. for 6 hours.

The resin solution thus prepared had a solid content of 40% and a viscosity of 24,000 cps (20° C.).

In addition, the solid concentration of the resin solution was adjusted to 20% with methyl ethyl ketone, whereby a comparative coating formulation was obtained.

COMPARATIVE EXAMPLE 2

The resin solution (100 parts) prepared in Comparative Example 1, 3 parts of "Teflon" powder ("Lublon L", trade name; product of Daikin Industries, Ltd.), 2 parts of polyethylene wax and 345 parts of methyl ethyl ketone/toluene (=1/1) were mixed into a liquid mixture.

To the above liquid mixture, an isocyanate (solid content: 50%; "Takenate D-204", trade name; product of Takeda Chemical Industries, Ltd.) was added in an amount to give a liquid mixture/isocyanate weight ratio of 24/3, whereby a comparative coating formulation was obtained.

COMPARATIVE EXAMPLE 3

In 1,000 parts of toluene, 100 parts of a silicone resin ("KS-841", trade name; product of ShinEtsu Chemical Co., Ltd.) and 1 part of a catalyst ("PL-7", trade name) were dissolved, whereby a coating formulation of the silicone resin was obtained.

Evaluation

Each of the coating formulations prepared in Examples 1-5 and Comparative Examples 1-3, respectively, was coated by a gravure coater onto the surface of a 6-μm thick polyethylene terephthalate film (product of Toray Industries Inc.) to give a dry coat thickness of 0.5 μm. The solvent was then caused to evaporate in a drier, whereby a heat-resistant lubrication layer was formed on the front side of the base material for a comparison test.

The back side of the base material film, which was opposite to the side with the heat-resistant layer formed as described above, was coated with an ink formulation of the below-described composition to give a coat thickness of 5 μm by roll coating after the ink formulation had been heated at 100° C. into a hot melt, whereby a transfer ink layer was formed for a comparison test. In this manner, various heat-sensitive recording materials were obtained using formulations prepared in Examples 1-5 and Comparative Examples 1-3, respectively.

| Ink composition | |
|---|---|
| Paraffin wax | 10 parts |
| Carnauba wax | 10 parts |
| Polybutene (product of Nippon Oil Co., Ltd.) | 1 part |
| Carbon black | 2 parts |

Using the heat-sensitive recording materials of Examples 1-5 and the samples of Comparative Examples 1-3, all obtained as described above, printing was conducted by a thin-film type thermal head under the condition of printing energy of 1 mJ/dot (4×10-4 cm$^2$). Sticking tendency and head smear were observed at that time to evaluate them.

Incidentally, those tests on physical properties were conducted after the heat-sensitive recording materials had been left over for 15 days at room temperature (23° C., 46% humidity).

The results are shown in Table 1. The sticking tendency was evaluated by subjecting each heat-sensitive recording material to a thermal recording test on an actual thermal printer and visually ranking in 5 stages the separability of the heat-sensitive recording material from the thermal head when the thermal head was repeatedly pressed against the heat-sensitive recording material. The heat-sensitive recording materials showed the best separability were ranked "5".

The head smear was evaluated by subjecting each heat-sensitive recording material to a thermal recording test on an actual thermal printer and visually observing the state of smear of the thermal head. The ranking was in 5 stages with "5" indicating the least smear.

TABLE 1

| | Sticking tendency | Head smear |
|---|---|---|
| Ex.1 | 5 | 5 |
| Ex.2 | 5 | 5 |
| Ex.3 | 5 | 5 |
| Ex.4 | 5 | 5 |
| Ex.5 | 5 | 5 |
| Comp. Ex. 1 | 1* | |
| Comp. Ex. 2 | 4 | 2 |
| Comp. Ex. 3 | 5 | 3 |

*Head was not allowed to run and the recording material was torn.

We claim:

1. In a heat-sensitive recording material comprising a base sheet material, a heat-sensitive recording layer provided on one side of the base sheet material and a heat-resistant layer provided on the other side of the base sheet material, the improvement wherein the heat-resistant layer is formed of a resin modified with a silane coupling agent, said silane coupling agent containing at least one free isocyanate group, and the modified resin containing one or more hydrolyzable silyl groups in side chains of the molecule of the resin.

2. The heat-sensitive recording material of claim 1, wherein the heat-resistant layer is curable using water as a curing agent.

3. The heat-sensitive recording material of claim 1, wherein said silane coupling agent containing at least one free isocyanate group is of the formula $$(R^1O)_n-\overset{(R^2)_m}{\overset{|}{Si}}-R^3-NCO$$

wherein $R^1$ is a lower alkyl group, $R^2$ is a lower alkyl or lower alkoxy group, $R^3$ is $C_{1-6}$ alkyl group, m stands for an integer of 1-3 and n is 3-m.

4. The heat-sensitive recording material of claim 1, wherein said silane coupling agent containing at least one free isocyanate group is the reaction product of a silane coupling agent containing one or more reactive organic functional groups and an organic polyisocyanate.

5. The heat-sensitive recording material of claim 4, wherein said silane coupling agent containing one or more reactive organic functional groups is of the formula $$X-R^4-\overset{(R^2)_m}{\overset{|}{Si}}(OR^1)_n$$

wherein X represents a group reactive with an isocyanate, $R^1$ is a lower alkyl group, $R^2$ is a lower alkyl group or lower alkoxy alkoxy group, m is an integer of 1–3, n is 3-m, and $R^4$ is a divalent organic group.

6. The heat-sensitive recording material of claim 5, wherein X is an amino, epoxy, hydroxyl or thiol group.

7. The heat-sensitive recording material of claim 2, further comprising a silanol condensation catalyst.

8. The heat-sensitive recording material of claim 7, wherein said condensation catalyst is a carboxylate salt or an amine salt.

9. The heat-sensitive recording material of claim 7, wherein said condensation catalyst is present in an amount of 0.0001–5 wt. %.

10. The heat-sensitive recording material of claim 8, wherein said condensation catalyst is present in an amount of 0.0001–5 wt. %.

* * * * *